US006955425B2

(12) United States Patent
Childs et al.

(10) Patent No.: US 6,955,425 B2
(45) Date of Patent: Oct. 18, 2005

(54) RE-CIRCULATING FLUID DELIVERY SYSTEMS

(75) Inventors: Ashley E. Childs, Corvallis, OR (US); Louis C. Barinaga, Salem, OR (US); Daniel D. Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/133,708

(22) Filed: Apr. 26, 2002

(65) Prior Publication Data

US 2003/0202072 A1 Oct. 30, 2003

(51) Int. Cl.[7] ..... B41J 2/18
(52) U.S. Cl. ..... 347/89; 347/92
(58) Field of Search ..... 347/85, 86, 87, 347/89, 92, 93

(56) References Cited

U.S. PATENT DOCUMENTS 5,751,300 A 5/1998 Cowger et al. ..... 347/6
5,847,736 A 12/1998 Kanbayashi et al. ..... 347/89
5,936,650 A 8/1999 Ouchida et al. ..... 347/89
6,152,559 A 11/2000 Kojima

FOREIGN PATENT DOCUMENTS

EP 0965452 A1 12/1999
EP 0967083 A2 12/1999
EP 0968829 A 1/2000

OTHER PUBLICATIONS

Patent Abstracts of Japan, vol. 012, No. 400 (M-756), Oct. 24, 1998 & JP 63 145039 A (NEC Corp), Jun. 17, 1988 *abstract*.
European Search Report mailded Sep. 4, 2003; Application No. EP 03 25 2569.

*Primary Examiner*—Mansih Shah
*Assistant Examiner*—Leonard Liang

(57) ABSTRACT

A re-circulating fluid delivery system includes an air-fluid separator structure, a fluid plenum in fluid communication with the separator structure, and a free fluid reservoir. A fluid re-circulation path fluidically couples the separator structure, the fluid plenum and the free fluid reservoir. A pump structure re-circulates fluid through the re-circulation path during a pump mode, wherein air bubbles may be separated from re-circulated fluid.

23 Claims, 5 Drawing Sheets

FIG. 4 Refill Efficiency on First Cycle vs Initial Extracted Volume
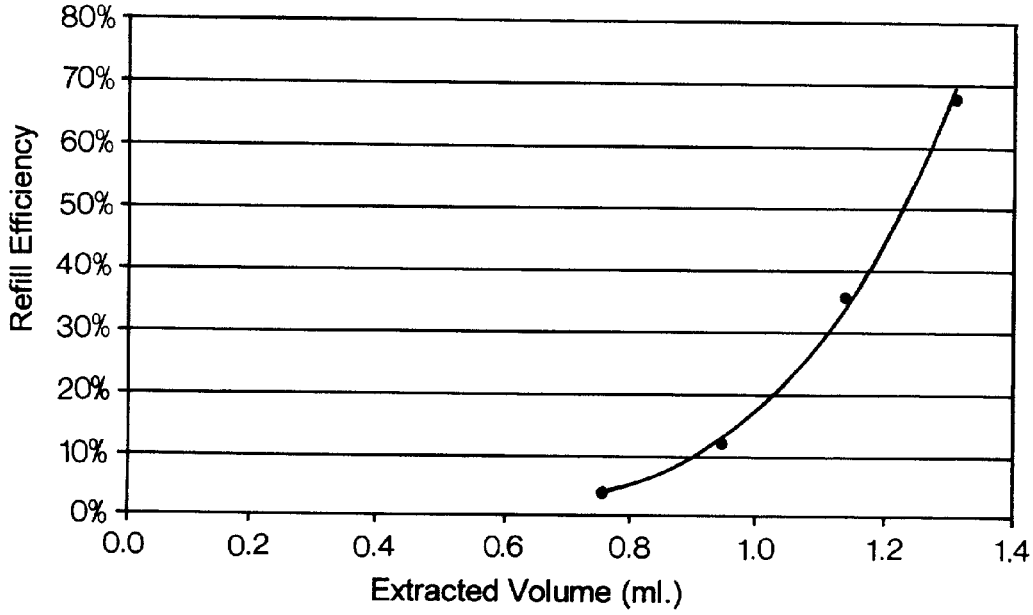
FIG. 5
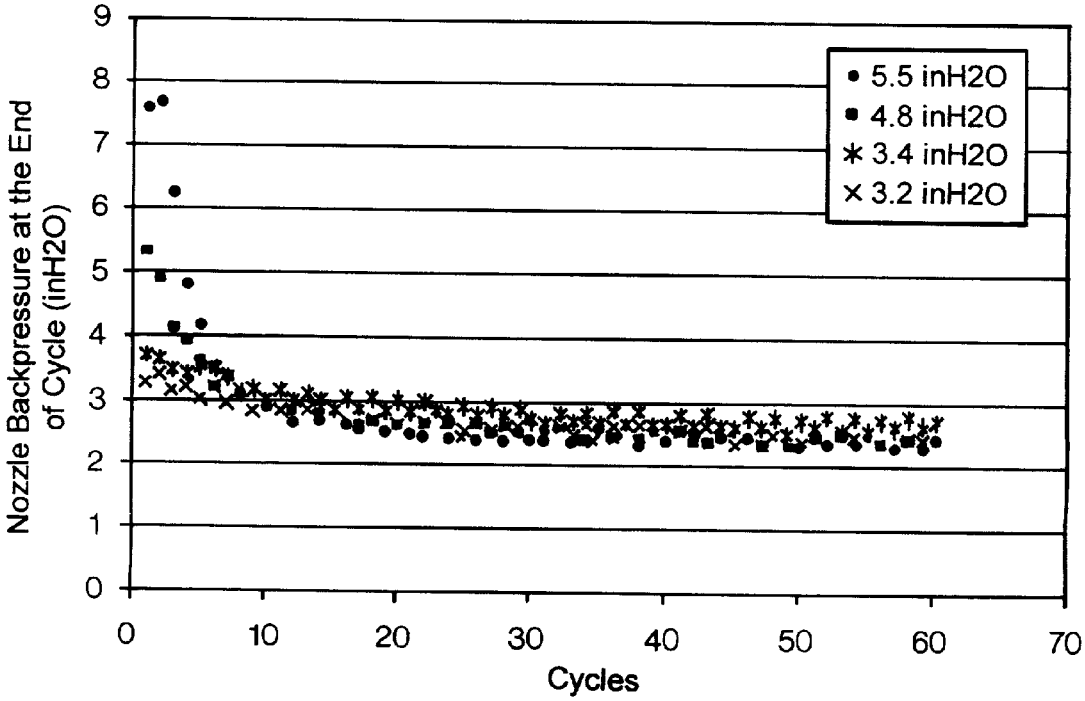

RE-CIRCULATING FLUID DELIVERY SYSTEMS

BACKGROUND OF THE DISCLOSURE

One exemplary application to which the present invention has utility is that of printing systems. Fluid delivery systems are in common use for delivering liquid ink in printing systems, such as ink-jet printing systems. One type of fluid delivery system is the re-circulating system type. Re-circulating fluid delivery systems are inherently air tolerant. These types of systems move air and ink from the print head region of a print cartridge, separate the air from the ink using either a foam block or by gravity, and circulate the ink back to the print head. The driving force of the re-circulation is generally the same as that to deliver ink.

One type of known re-circulating fluid delivery system employs tubes through which the fluid is delivered. Tubes add significant cost to the fluid delivery system, and increase the amount of force required to drive the print head back and forth during printing. These tube-based systems allow fluid to flow bi-directionally, that is, from the fluid supply to the print head and from the print head to the fluid supply. The system refills the cartridge, with fluid flowing from the supply to the print head. Then, to obtain the correct pressure, excess fluid is caused to flow back from the print head to the fluid supply. The system can overshoot its operating pressure, or set point, and is therefore at risk for overfilling. The set point is negative pressure, referred to as back pressure. If the cartridge were overfilled, poor print quality or drooling out of the nozzles could result.

SUMMARY OF THE DISCLOSURE

A re-circulating fluid delivery system is described. The system includes an air-fluid separator structure, an air vent region, a fluid plenum in fluid communication with the separator structure, and a free fluid reservoir. A fluid re-circulation path fluidically couples the separator structure, the fluid plenum and the free fluid reservoir. A pump structure re-circulates fluid through the re-circulation path during a pump mode, wherein air bubbles may be separated from re-circulated fluid and vented to atmosphere from the air vent region.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 graphically illustrates an exemplary refill efficiency for a prototype of the system of FIG. 1.

FIG. 5 illustrates the refill process over a number of cycles, plotting for an exemplary embodiment nozzle back-pressure at the end of a cycle as a function of the cycle count.

DETAILED DESCRIPTION OF THE DISCLOSURE

Figure 1:
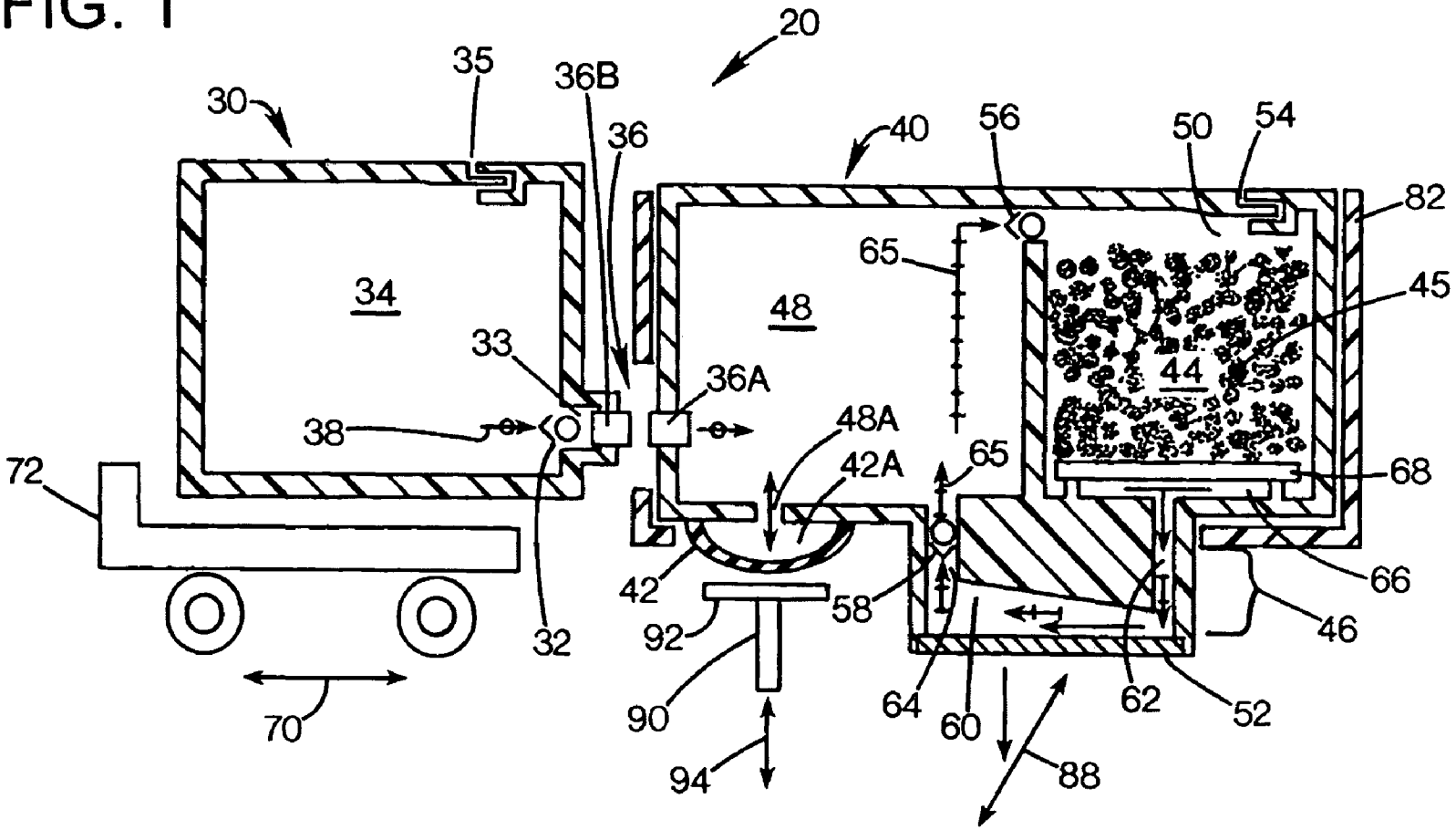
FIG. 1 is a schematic illustration of an embodiment of a re-circulating fluid delivery system in accordance with the invention.

An exemplary embodiment of a re-circulating fluid delivery system 20 in accordance with aspects of the invention is schematically illustrated in FIG. 1. The system comprises a fluid supply 30, a print cartridge 40 incorporating a pump structure 42 and an air-fluid separator 44. A fluidic interconnect 36 provides a fluid path between the fluid supply and the print cartridge. The air-fluid separator includes a body 45 of some form of capillary material, such as bonded-polyester fiber foam, polyurethane foam or glass beads. In this embodiment, the pump structure 42 is a pump diaphragm that includes an elastomer material formed into a convex shape with an internal spring that rebounds the pump volume after the elastomer is pushed in by an external driving force.

Exemplary fluid interconnect structures suitable for the purpose as 36A, 36B are known, such as needle-septum interconnects, e.g. as described in U.S. Pat. No. 5,815,182.

The fluid supply 30 can include a volume 34 of free fluid within a rigid container having a vent 35, or in a flaccid bag. If a vent is used, it is open during use, but sealed during shipping to prevent leakage. In either case, in this exemplary embodiment, the fluid supply has a high-cracking pressure check valve 32 at its outlet port 33. The outlet port also has a fluid interconnect structure 36B, for mating with a corresponding fluid interconnect structure 36A on the print cartridge 40. Exemplary cracking pressure for the check valve suitable for the purpose in an exemplary embodiment are in the range of 12 to 20 inches of water.

The print cartridge 40 includes, in addition to the capillary material/air-fluid separator 44, a standpipe area 46, a free fluid chamber 48, an air vent region 50 and a printhead 52 which ejects droplets of fluid through a nozzle array. In this embodiment, the fluid is a liquid ink during normal printing operations. The fluid can alternatively be a cleaning fluid, a benign shipping fluid, a make-up fluid or the like.

The printhead 52 can be any of a variety of types of fluid ejection structures, e.g. a thermal inkjet printhead or a piezoelectric printhead.

In the exemplary embodiment of FIG. 1, the separator 44 also provides back pressure to the printhead 52. The capillary material in an exemplary embodiment is selected to provide a static back pressure in the range of 2 to 6 inches of water. The air vent region 50 of the air fluid separator 44 is a small volume of humid air above the capillary material 45 that is vented to atmosphere via a labyrinth vent 54.

The standpipe region 46 includes a fluid plenum 60 in fluid communication with the printhead 52, supplied with fluid through channel 62 from open region 66 below a filter 68 separating the capillary material 45 from region 66. The filter 68 can be fabricated, e.g, from a fine mesh screen, e.g. with a 6 micron nominal opening size in an exemplary embodiment. The filter is characterized by a high bubble pressure characteristic, which is sufficient to prevent passage of air bubbles under conditions experienced by the print cartridge during shipping, operation or storage.

The print cartridge 40 includes two one-way check valves 56, 58. Check valve 56 is disposed in a fluid path between the top of the free fluid chamber 48 and the air vent region 50, allowing air and fluid to flow from the chamber 48 into separator 44 and air vent region 50 when the cracking pressure of the valve is exceeded. Fluid flow from the region 50 into chamber 48 is prevented by the check valve 56. Check valve 58 is disposed in a fluid channel 64 between the standpipe region 46 and the free fluid chamber 48, permitting fluid to flow from the standpipe region into the free fluid chamber 48 when the cracking pressure of the valve 58 is exceeded, while preventing fluid flow in the opposite direction from chamber 48 to plenum 60. In an exemplary embodiment, the valves 56, 58 have a cracking pressure in the range of 2 to 3 inches of water, and in one exemplary embodiment, a cracking pressure of 3.25 inches of water. For this embodiment, the plenum static pressure is on the order of −2 to −6 inches of water, and while printing a plenum dynamic pressure in the range of −2 to −12 inches of water. While pumping, the plenum pressure could be as high as −25 to −30 inches of water, or a negative pressure below a threshold at which air bubbles would be ingested through the print head nozzles, since print quality is not an issue during pumping.

Figure 2A:
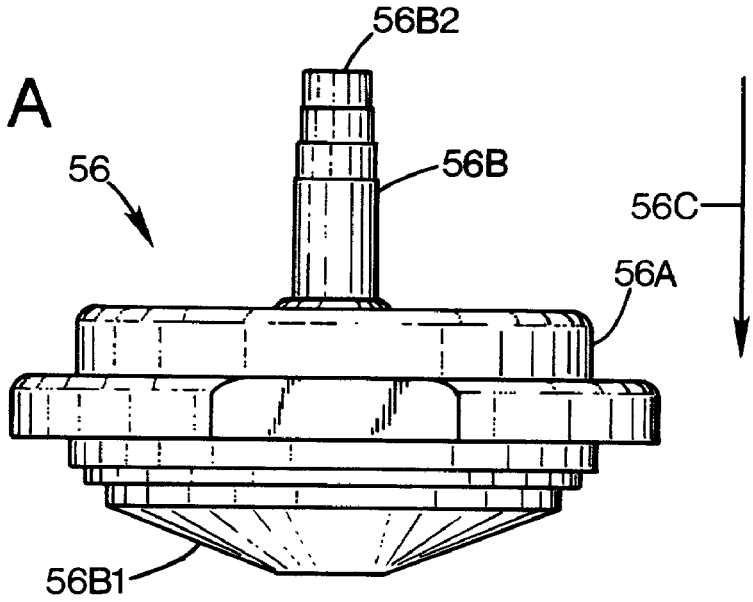
FIGS. 2A and 2B are side and isometric end views of an exemplary check valve structure usable in the system of FIG. 1.
Figure 2B:
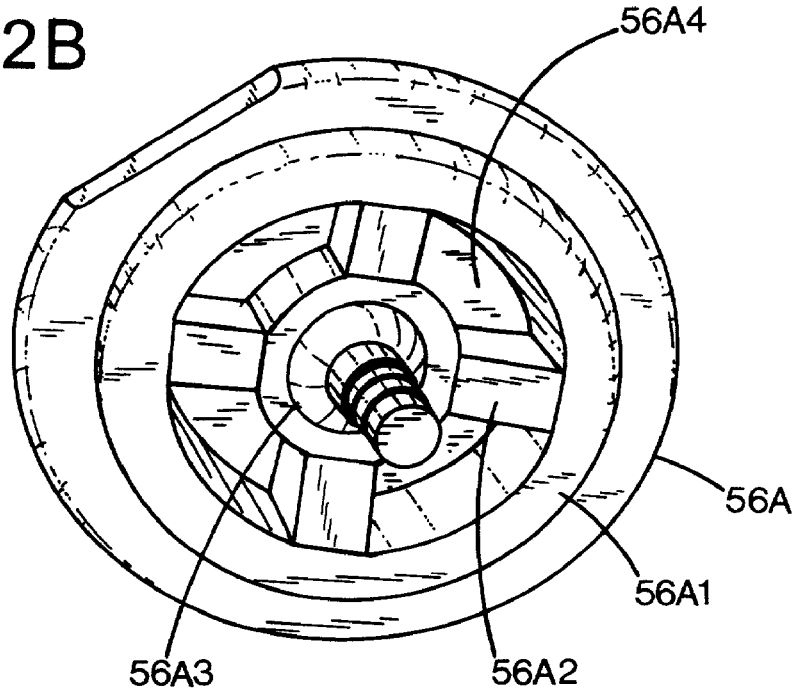

There are many types of check valve structures which can be employed to perform the function of the check valves 56, 58 and 32 for the system. One exemplary type of valve structure is illustrated in FIGS. 2A–2B. This valve structure is illustrated as check valve 58, but is also usable for the other check valves as well. The valve structure is an umbrella valve, having a valve seat structure 56A which has an outer frame 56A1 with ribs 56A2 radiating from a hub 56A3, the ribs separated by openings 56A4. An umbrella structure 56B includes umbrella 56B1 integrally formed with post 56B2 which is positioned through the hub of the seat structure. The seat structure is fabricated of a rigid plastic material such as PPS, MABS, ABS, PET or LCP; the umbrella structure 56B is fabricated of an elastomeric material such as silicone, EPDM, or an thermoplastic elastomer, to permit the deflection of the umbrella away from the rim of the seat structure in response to fluid pressure exceeding the break pressure, allowing fluid to flow through the valve in the direction of arrow 56C (FIG. 2A).

Figure 3:
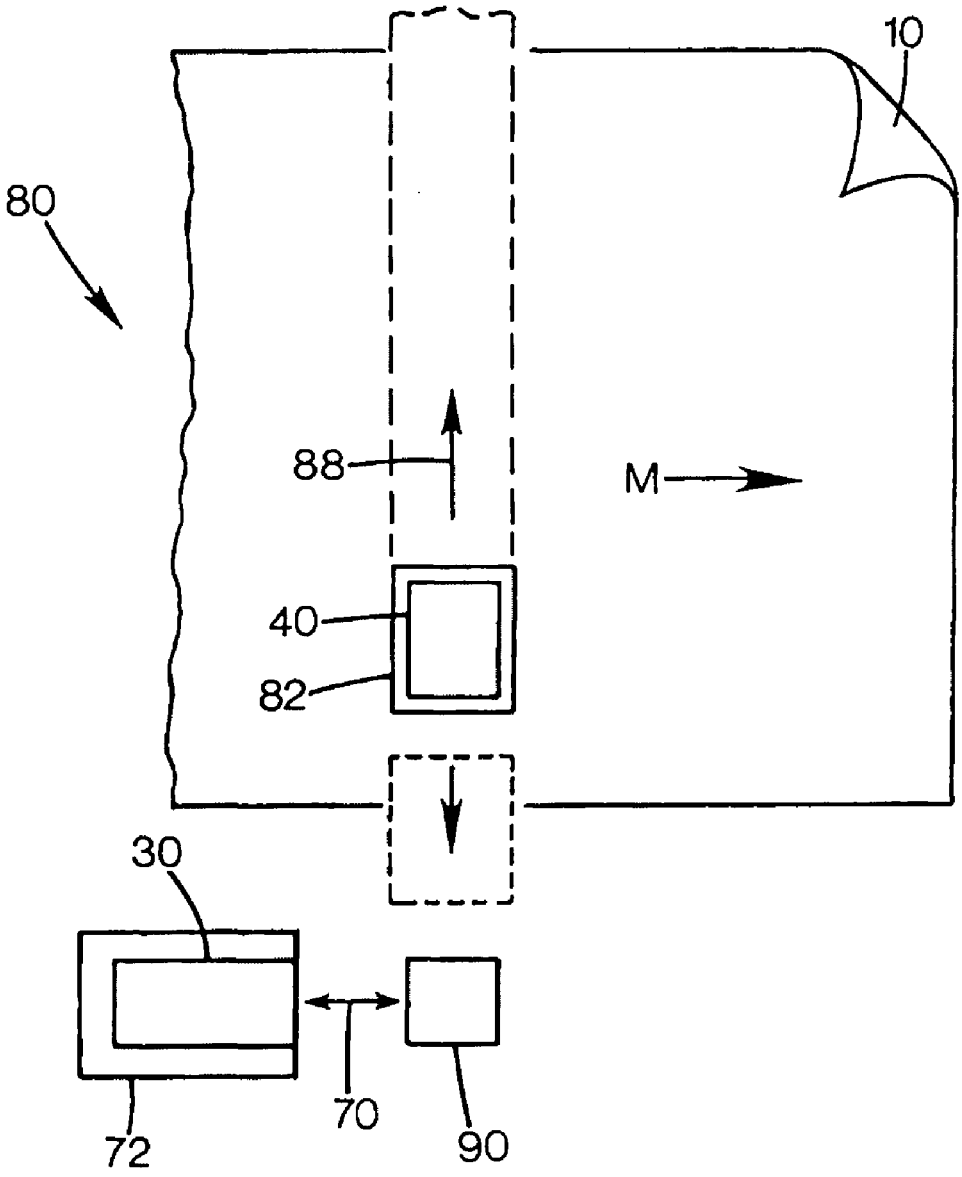
FIG. 3 is a schematic diagram of a printer system employing the fluid delivery system of FIG. 1.

In an exemplary embodiment, the print cartridge 40 is mounted on a traversing carriage 82 of a printer 80, and the carriage is driven along a swath axis 88 during printing operations, as depicted schematically in FIG. 3. The swath axis is substantially perpendicular to the motion of print media 10 through the printer, as indicated by arrow M. The fluid supply 30 is mounted on a printer supply shuttle 72 at a supply station. The shuttle can be driven to move the fluid supply along a supply axis 70 which is transverse to the swath axis between a supply rest position (shown in FIG. 1) and an engaged position where the fluid interconnect 36B is mated with corresponding fluid interconnect 36A of the print cartridge. Of course, other arrangements could alternatively be employed, e.g., the fluid interconnect axis could be parallel to the carriage axis.

At system start-up, the carriage 82 is moved along the swath axis 88 to position the print cartridge at the supply station. Then, a printer shuttle mechanism linearly actuates the shuttle 72 to move the fluid supply 30 along axis 70 toward the print cartridge to temporarily connect to the print cartridge 40 through the fluid interconnect structures 36A, 36B. The print cartridge 40 is assumed to be in a fluid-depleted state, requiring fluid so that the maximum amount of pages can be printed before the next refill. The printer then actuates a mechanism 90 to drive the pump on the print cartridge, causing fluid to flow from the fluid supply to the print cartridge. The mechanism 90 can include an actuator 92 which is reciprocated along actuator axis 94 (FIG. 1) to contact and compress the pump diaphragm 42 in repeated cycles of the actuator operation. This collapses the pump chamber 42A, forcing fluid in the chamber through opening 48A into the free fluid chamber 48. This in turn forces fluid and air through check valve 56 into the separator 44. Other types of pump structures could alternatively be employed, e.g, piston or electro-mechanical structures.

While fluid is being pumped into the free fluid chamber 48 in the print cartridge, a small amount of fluid is also flowing from the plenum 60 through channel 64 and check valve 58 along the recirculation path indicated by arrows 65 of the print cartridge into the free fluid chamber 48.

The dynamic flow loss through the capillary material 45 is quite high during the first one or two cycles of pump operation, since the capillary material is highly depleted at the initial stage of refilling and the filter 68 has a high bubble pressure characteristic preventing flow of air bubbles through the filter under normal operating, storage and pumping conditions experienced by the print cartridge. Therefore flow through the air-fluid separator 44 is not the most preferred path for fluid flow. Less flow resistance exists through the fluid supply path 38, i.e. from the supply 30 through interconnect 36, and fluid is drawn in from the supply 30 initially at about 50%–70% of each pump volume, i.e. the volume of pump chamber 42A, in an exemplary embodiment. The amount of fluid drawn in from the supply 30 during refill divided by the pump volume is referred to as the refill efficiency. The refill efficiency drops from about 70%–50% on the first one or two pump cycles very quickly as the print cartridge refills. FIG. 4 graphically illustrates an exemplary refill efficiency for a prototype of the system 20.

As the refill efficiency drops off, the amount of fluid recirculating through path 65 increases. As the print cartridge 40 takes on more fluid, the capillary material 45 becomes more saturated and the dynamic flow loss through the capillary material and the filter 68 decreases, making it easier to draw fluid from the standpipe region. The system therefore takes on smaller amounts of fluid from the fluid supply 30 as it approaches its equilibrium, or set point. The set point is the back pressure that is optimal for printing, and in an exemplary embodiment it is also the same back pressure in the standpipe at which full re-circulation takes place, i.e., when the refill efficiency is 0%. At this set point, the pump volume is replenished completely via the re-circulation path 65, instead of from the fluid supply 30.

FIG. 5 illustrates an exemplary refill process over a number of cycles, plotting for an exemplary embodiment nozzle back pressure at the end of a cycle as a function of the cycle count, with one cycle consisting of a pump actuation in and subsequent rebound. FIG. 5 shows the inherent stability of the system of FIG. 1. If, as in prior solutions, the system overfilled the print cartridge and then withdrew excess fluid back into the supply, then the back pressure would drop down below the set point of 2.4 inches of water and then return to set point some cycles later. In this embodiment, the system reaches its set point without overfilling.

After a complete fill, the print cartridge 40 is ready to print. The size of the capillary material in the print cartridge determines the number of pages that can be printed before refill is required. The number of drops per page will vary the number of pages possible.

During printing, air that is generated due to outgassing of the fluid will accumulate in the small standpipe fluid channels 62, 64 (FIG. 1). Without connecting to the fluid supply 30, an air purging routine can be performed on the print cartridge 40 to purge air from the channels 62, 64. The fluidic connection at interconnect structure 36A is normally closed, and opens only upon connection to the fluid supply 30. The carriage 82 is moved to the supply station, and, with the fluid supply 30 still in its rest position out of engagement with the print cartridge, the pump mechanism 90 is activated. Any air in the standpipe region 46 can be circulated through the recirculation path 65 and separated in the air-fluid separator 44 without connecting the print cartridge to the fluid supply.

During long periods of idle time, or between print jobs, the printer can purge air from the printhead without having to actuate the fluid interconnects or the supply shuttle if refill is not required. This can reduce the wear of the fluid interconnects and supply shuttle components, and save time for the servicing routine, since the supply shuttle would not have to be activated.

Figure 6:
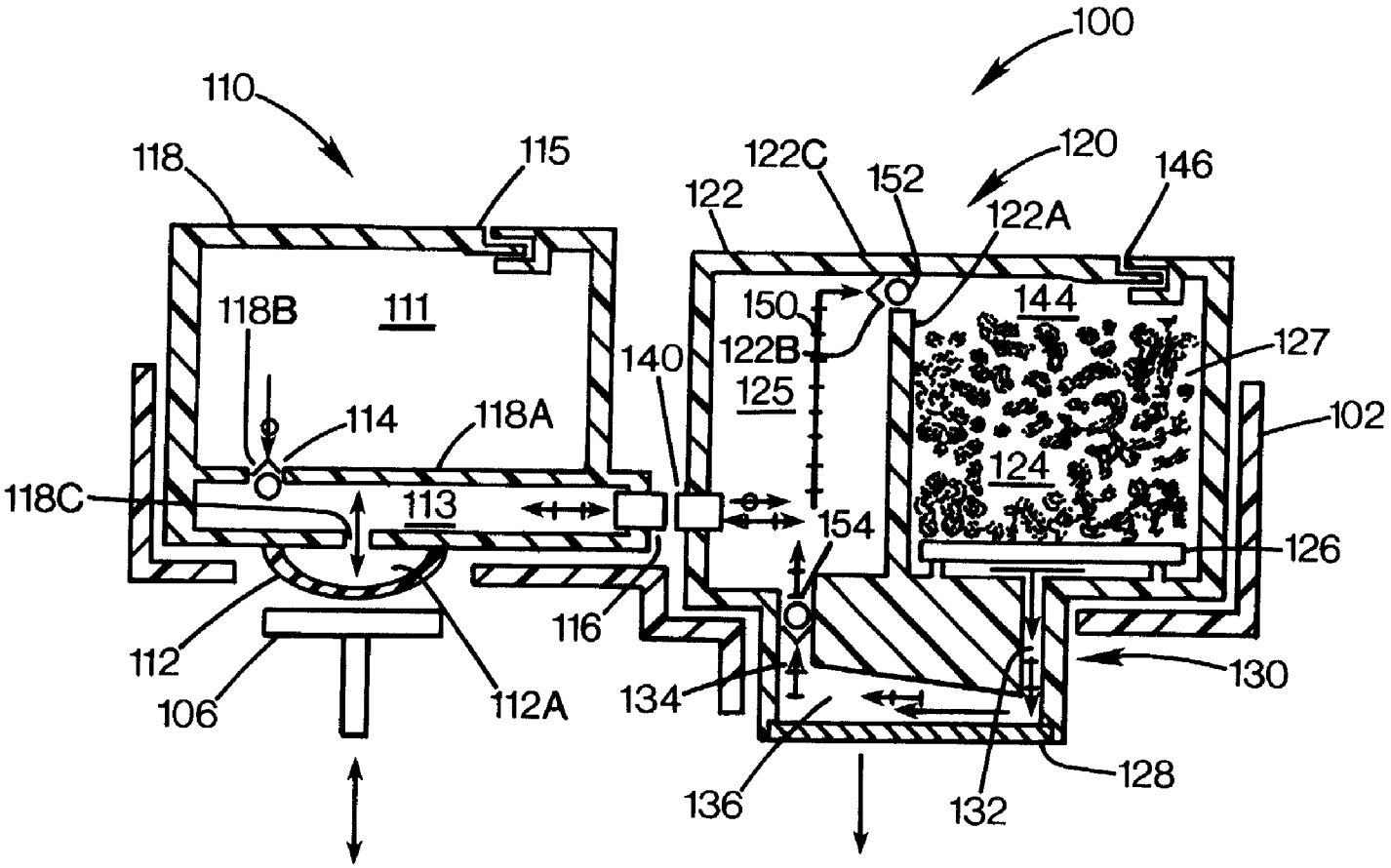
FIG. 6 is a schematic illustration of an alternate embodiment of a fluid delivery system in accordance with the invention.

An alternate embodiment of a fluid delivery system 100 is illustrated in FIG. 6. The fluid supply/print head arrangement is commonly referred to as a "snapper" system, since the supply has a fluid interconnect which snaps together with a fluid interconnect on the print head, and remains snapped together during printing, the printer carriage 102 holding both the print cartridge and the fluid supply. In this embodiment, the pump is still located "on axis," i.e. on the traversing carriage 102, but is fabricated as part of the fluid supply. This increases the reliability of the pump system, since the diaphragm is replaced each time a new fluid supply is installed.

The system 100 shown in schematic form in FIG. 6 includes the fluid supply 110 which holds a supply of fluid in an internal fluid reservoir 111. The reservoir 111 is vented to the atmosphere through a labyrinth vent 115, which is open during use, but sealing during shipping to prevent leakage. The supply housing 118 includes an internal wall structure 118A, separating reservoir 111 from a free fluid chamber 113. The wall structure 118A has an opening 118B formed therein, with a check valve 114 disposed in the opening to prevent fluid from flowing from chamber 113 into reservoir 111.

The fluid supply 110 has a pump structure 112 attached to the housing 118, in fluid communication with the fluid chamber 113. In an exemplary embodiment, the pump structure 112 is a diaphragm pump structure, although other types of fluid pumping structures could alternatively be employed, such as a spring-loaded piston pump. The pump diaphragm 112 defines a pump chamber 112A which communicates with chamber 113 through port 118C, which allows bi-directional fluid flow between the chambers 113, 112A.

The fluid supply 110 includes a fluid interconnect structure 116 for engaging a corresponding interconnect structure 140 on the print cartridge 120. Exemplary fluid interconnect structures suitable for the purpose include needle/septum structures, such as those described in U.S. Pat. No. 5,815,182.

The print cartridge 120 includes a housing 122 with an internal wall structure 122A, forming a free fluid chamber 125 separated by wall structure 122A from reservoir 127, with a check valve 152 disposed at an opening 122B in the wall structure 122A adjacent the top wall 122C. A body 124 of capillary material is disposed in reservoir 127, forming an air-fluid separator.

The print cartridge further includes a standpipe area 130, an air vent region 144 and a printhead 128 which ejects droplets of fluid through a nozzle array. In the exemplary embodiment of FIG. 6, the separator 124 also provides back pressure to the printhead. The air vent region 144 is a small volume of humid air above the separator 124 that is vented to atmosphere via a labyrinth vent 146.

The standpipe region 130 includes fluid flow channels 132, 134 leading to a fluid plenum 136 above the printhead 128. Channel 132 communicates with the separator 124 through a filter 126. Channel 134 communicates with free fluid chamber 125. A check valve 154 is positioned in the channel 134.

Check valve 152 permits one-way fluid flow from the free fluid chamber 125 to the separator 124 when the break pressure of the valve is exceeded, preventing fluid flow in the opposite direction. Check valve 154 permits one-way fluid flow in channel 134 between the plenum 136 and the free fluid chamber 125 when the break pressure of the valve is exceeded, preventing fluid flow in the opposite direction.

A recirculation path 150 allows fluid to be recirculated, through action of the pump 112, through the free fluid chamber 125 and valve 152 to the capillary material 124, the standpipe channel 132, plenum 136, channel 134, through valve 154 back to the free fluid chamber 125, and between the chamber 113 of the fluid supply through interconnects 116, 140. The pump 112 actuation occurs in one exemplary embodiment by moving the carriage to a service station at which the actuator 106 is disposed, and then reciprocating the actuator 106 by a pump actuator mechanism to repetitively cycle the pump diaphragm.

The check valves 152, 154 have break pressures in an exemplary embodiment in the range of 2 to 4 inches of water. The supply check valve 114 has a break pressure in an exemplary embodiment in a range of 12 to 20 inches of water, and is high enough to account for flow losses through the fluid interconnect. The break pressures are balanced with the dynamic flow losses through the recirculation path and capillary material.

The system 100 illustrated in FIG. 6 provides an on-axis fluid supply with an air tolerant re-circulation system. An air-fluid separator is located on-axis with the fluid supply, allowing air tolerance without requiring large amounts of fluid to be wasted for air purging. Moreover, incorporating the pump into the fluid supply, as in the embodiment of FIG. 6, allows a more reliable pump, since the pump diaphragm is replaced with the fluid supply. The pump material properties may change over time in contact with the fluid due to solvent absorption or creep. Since the pump will undergo many cycles, fatigue may cause damage. If the pump diaphragm is replaced periodically, the required material life is much shorter and may allow reduced cost over a permanent pump.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A re-circulating fluid delivery system, comprising:

a print cartridge housing structure;

an air-fluid separator structure disposed in said housing structure, the separator structure including an air vent;

a fluid plenum in fluid communication with said separator structure;

a printhead mounted to said housing structure and in fluid communication with said plenum;

a free fluid reservoir disposed in said housing structure;

a fluid re-circulation path entirely within said housing structure fluidically coupling said separator structure, said fluid plenum and said free fluid reservoir; and a pump structure for re-circulating fluid through said re-circulation path during a pump mode, wherein air bubbles may be separated from re-circulated fluid and vented to atmosphere from said air vent region.

2. The system of claim 1, wherein said fluid re-circulation path has disposed therein at least one check valve permitting fluid flow in a re-circulation direction.

3. The system of claim 1, wherein said pump structure is mounted to said housing structure.

4. The system of claim 1 further comprising a fluid supply external to said housing structure and a fluid interconnect structure for removable connection of the fluid supply to the free fluid reservoir.

5. The system of claim 4, wherein said fluid supply and said free fluid reservoir are intermittently connectable during a refill mode, and are disconnected during printing operations performed by said printhead.

6. The system of claim 5, wherein said pump structure is mounted to said housing structure.

7. The system of claim 1 further comprising a pump actuator for actuating said pump structure during a refill mode or a recirculation mode.

8. The system of claim 1, wherein the air-fluid separator structure includes a body of capillary material.

9. The system of claim 8, wherein the air-fluid separator structure includes a filter structure preventing passage of air bubbles through the fitter structure under normal operating, shipping and storage conditions experienced by the system and during the pump mode.

10. A re-circulating fluid delivery system, comprising:

a print cartridge housing structure;

separator means for separating air from fluid and venting air from the housing structure, said separator means disposed in said housing structure;

a fluid plenum in fluid communication with the separating means;

fluid ejecting means for ejecting droplets of fluid mounted to said housing structure and in fluid communication with said plenum;

reservoir means for holding a supply of fluid in said housing structure;

a fluid re-circulation path entirely within said housing structure fluidically coupling said separating means, said fluid plenum and said reservoir means; and re-circulation means for re-circulating fluid through said re-circulation path during a re-circulation mode, wherein air bubbles may be separated from re-circulated fluid and vented from the housing structure.

11. The system of claim 10, wherein said fluid re-circulation path has disposed therein at least one check valve means permitting fluid flow in a re-circulation direction.

12. The system of claim 10, wherein said re-circulation means includes a pump structure mounted to said housing structure.

13. The system of claim 10 further comprising a supply means for holding a supply of fluid external to said housing structure and an interconnect means for establishing a fluid connection between the supply means and said reservoir means.

14. The system of claim 13, wherein said fluid supply and said housing structure are intermittently connectable during a refill mode, and are disconnected during printing operations performed by said fluid ejecting means.

15. The system of claim 10 further comprising actuator means for actuating said re-circulation means during a refill mode or a recirculation mode.

16. The system of claim 10, wherein the separator means includes a body of capillary material.

17. A re-circulating fluid delivery system, comprising:

a print cartridge housing structure;

an air-fluid separator structure in said housing structure;

an air vent region in communication with the separator structure;

a fluid plenum disposed in said housing structure in fluid communication with said separator structure;

a free fluid reservoir disposed in said housing structure;

a fluid re-circulation path entirely within said housing structure, the fluid recirculation path fluidically coupling said separator structure, said fluid plenum and said free fluid reservoir;

a pump structure for re-circulating fluid through said re-circulation path during a pump mode;

a fluid supply external to said housing structure; and a fluid interconnect structure for removable connection of the fluid supply to the free fluid reservoir to provide replenishment of fluid in the free fluid reservoir during fluid recirculation, wherein said fluid supply and said print cartridge are intermittently connectable during a refill mode, and are disconnected during printing operations performed by said print cartridge.

18. The system of claim 17, wherein said fluid re-circulation path has disposed therein at least one check valve permitting fluid flow in a re-circulation direction.

19. The system of claim 17, wherein;

said pump structure is disposed on or in said housing structure.

20. The system of claim 17, further including a printhead in fluid communication with said plenum.

21. A re-circulating fluid delivery system, comprising:

a print cartridge housing structure;

an air-fluid separator structure in said housing structure;

an air vent region in communication with the separator structure;

a fluid plenum disposed in said housing structure in fluid communication with said separator structure;

a free fluid reservoir disposed in said housing structure;

a fluid re-circulation path entirely within said housing structure, the fluid recirculation path fluidically coupling said separator structure, said fluid plenum and said free fluid reservoir;

a pump structure for re-circulating fluid through said re-circulation path during a pump mode;

a fluid supply external to said housing structure;

a fluid interconnect structure for removable connection of the fluid supply to the free fluid reservoir to provide replenishment of fluid in the free fluid reservoir during fluid recirculation; and a pump actuator for actuating said pump structure during a refill mode or a recirculation mode.

22. A re-circulating fluid delivery system, comprising:

a print cartridge housing structure;

an air-fluid separator structure in said housing structure, wherein the air-fluid separator structure includes a body of capillary material;

an air vent region in communication with the separator structure;

a fluid plenum disposed in said housing structure in fluid communication with said separator structure;

a free fluid reservoir disposed in said housing structure;

a fluid re-circulation path entirely within said housing structure, the fluid recirculation path fluidically coupling said separator structure, said fluid plenum and said free fluid reservoir;

a pump structure for re-circulating fluid through said re-circulation path during a pump mode;

a fluid supply external to said housing structure; and a fluid interconnect structure for removable connection of the fluid supply to the free fluid reservoir to provide replenishment of fluid in the free fluid reservoir during fluid recirculation.

23. The system of claim 22, wherein the air-fluid separator structure includes a filter preventing passage of air bubbles through the filter structure under normal operating, shipping and storage conditions experienced by the system.

* * * * *

UNITED STATES PATENT AND TRADEMARK OFFICE

CERTIFICATE OF CORRECTION

PATENT NO. : 6,955,425 B2
APPLICATION NO. : 10/133708
DATED : October 18, 2005
INVENTOR(S) : Ashley E. Childs et al.

It is certified that error appears in the above-identified patent and that said Letters Patent is hereby corrected as shown below:

IN THE CLAIMS

Claim 9, Column 7, line 23, delete “fitter” and insert therefor --filter--

Signed and Sealed this

Twenty-sixth Day of June, 2007

JON W. DUDAS
*Director of the United States Patent and Trademark Office*